US008091285B1

(12) United States Patent
Wolf et al.

(10) Patent No.: US 8,091,285 B1
(45) Date of Patent: Jan. 10, 2012

(54) STORM SHUTTER FASTENER AND QUICK RELEASE SYSTEM FOR EMERGENCY EGRESS

(75) Inventors: Edward A. Wolf, Parkland, FL (US); Mark Clark, Loxahatchee, FL (US)

(73) Assignee: Integridyne LC, Palm Coast, FL (US)

( * ) Notice: Subject to any disclaimer, the term of this patent is extended or adjusted under 35 U.S.C. 154(b) by 1181 days.

(21) Appl. No.: 11/460,387

(22) Filed: Jul. 27, 2006

(51) Int. Cl.
*E06B 3/32* (2006.01)

(52) U.S. Cl. ..... 49/463; 49/465; 49/61; 292/301; 292/300; 52/202; 52/203

(58) Field of Classification Search ..... 52/202–203; 49/463, 465, 61, 62; 292/341.15, 155, 301
See application file for complete search history.

(56) References Cited

U.S. PATENT DOCUMENTS

| | | | | |
|---|---|---|---|---|
| 4,131,970 | A * | 1/1979 | Le Van | 16/270 |
| 4,263,747 | A * | 4/1981 | Coltrin et al. | 49/56 |
| 4,897,961 | A * | 2/1990 | Shine | 49/141 |
| 5,410,841 | A * | 5/1995 | Harris et al. | 49/67 |
| 5,619,821 | A * | 4/1997 | St. George et al. | 49/57 |
| 6,363,670 | B1 * | 4/2002 | Dewitt | 52/202 |
| 6,637,784 | B1 * | 10/2003 | Hauber et al. | 292/300 |
| 6,745,522 | B2 * | 6/2004 | Germain | 52/202 |
| 7,062,884 | B2 * | 6/2006 | Jaycox et al. | 52/203 |
| 7,469,502 | B1 * | 12/2008 | Steel | 49/465 |
| 7,526,896 | B1 * | 5/2009 | Lohmeyer et al. | 52/202 |
| 7,559,715 | B2 * | 7/2009 | Germain et al. | 403/294 |
| 7,565,776 | B2 * | 7/2009 | Wolf et al. | 52/202 |
| 2003/0159372 | A1 * | 8/2003 | Motro | 52/202 |
| 2006/0086057 | A1 * | 4/2006 | Rasenberger et al. | 52/202 |
| 2006/0288646 | A1 * | 12/2006 | Pleasants | 49/465 |
| 2007/0107328 | A1 * | 5/2007 | Munch | 52/202 |
| 2009/0019797 | A1 * | 1/2009 | Gunn | 52/202 |

* cited by examiner

*Primary Examiner* — Kristina Fulton
(74) *Attorney, Agent, or Firm* — Malin Haley DiMaggio Bowen & Lhota, P.A.

(57) ABSTRACT

A storm and hurricane shutter quick release mechanism for permitting quick egress from a building that has storm shutters attached to the doors and windows to allow someone inside the building to leave the building quickly. The system includes a quick release housing mounted at the base of each shutter panel attached to the building that includes removable studs that are actuated by a cam mechanism from the inside of the building that release the attaching studs that hold the shutters in place from the quick release housing thereby releasing the shutter fasteners at the base allowing the shutters to be quickly removed by actuating the cam mechanism from inside the building.

6 Claims, 10 Drawing Sheets

STORM SHUTTER FASTENER AND QUICK RELEASE SYSTEM FOR EMERGENCY EGRESS

BACKGROUND OF THE INVENTION

1. Field of the Invention

This invention relates to a fastener and quick release system for removable storm and hurricane shutters for building door and window openings. The quick release mechanism can be readily actuated from inside the building for fast egress in an emergency. The quick release fastener 18 which is mounted at the outside on the free end of each stud is shown in Applicants' pending patent application, U.S. application Ser. No. 10/908,999 filed Jun. 3, 2005 entitled: "Escape Mechanism for Hurricane Shutters," the contents of which are incorporated by reference into this application.

2. Description of Related Art

The utilization of protective coverings for doors and windows such as storm shutters and hurricane shutters is well known in the prior art. Many hurricane shutters that cover windows and doors are bolted in place with a series of overlapping panels that are mounted in rigid tracks using bolts and other fasteners to hold each shutter panel in position.

One of the drawbacks of such hurricane shutters is that anyone inside of a building having the window and door openings covered with hurricane shutters cannot get out while the shutters are fastened in place from the outside without, in most cases, going outside of the building and unfastening all of the bolt fasteners to remove each panel. Another drawback to conventional shutters is the fact that if the building required immediate ingress or access such as from the fire department or police department, again, at least one shutter panel would have to be individually removed. Such a requirement is time consuming.

Shutters that are utilized to make the job of installing or removing shutters faster and easier have been shown in the prior art.

One of the purposes of the invention described herein is to provide conventional reliable, sturdy hurricane and storm shutters for building windows and doors, and a shutter panel quick release mechanism that can be activated from inside the building that allows each shutter panel to be easily and quickly removed from the building itself in case of an emergency. However, when in place, the shutters are securely anchored, covering the building window or door areas.

SUMMARY OF THE INVENTION

The present invention contemplates a storm shutter fastener and quick release system that includes removably fastening each shutter panel over a window or door. The system includes releaseable studs that fasten the shutter to a building, a stud release housing for retaining and releasing the studs attached to the building, a rod mounted in the quick release housing that engages every stud and a release lever connected within the quick release housing engaging said rod for releasing the studs from the quick release housing. A manually activated release lever allows the individual studs that retain the shutters to be disengaged upon rotation of the release lever from inside or outside the building for quick egress.

For a conventional building opening such as a window or door, the storm and hurricane shutter system includes an upper track firmly mounted to the building with anchor bolts, the upper track being sized to include a shutter panel receiving channel that receives and engages the upper ends of each shutter panel to hold each panel in place above the window or door opening.

The shutter fastener and quick release housing is mounted below the window or door opening to the building.

The quick release housing contains a cam that engages a stud locking bar mounted inside the quick release housing in channels.

The quick release housing includes an elongated extruded metal bar having an internal longitudinal channel. A longitudinal interior rigid cylindrical rod is sized to engage each removable stud. Each stud has a recess that engages the stud locking rod in a locked position.

A rotatable cam is mounted inside the quick release housing that can engage or disengage the stud locking rod depending on the position of the release lever.

The front of the quick release housing includes apertures sized to receive the wall anchors that are mounted into the wall of the building that fasten the quick release housing to the building wall.

The rotatable cam can also be activated by a separate manual tool to release the studs.

It is an object of this invention to provide a hurricane shutter quick release system and method that allows for securely fastening shutters over building doors or windows that can be quickly released from inside the building by rotation of a lever for quick egress during an emergency.

It is yet another object of this invention to provide a hurricane shutter release mechanism that releases the studs that securely hold the storm shutters to a building that can be quickly released in an emergency through the actuation of a lever arm inside the building.

In accordance with these and other objects which will become apparent hereinafter, the instant invention will now be described with particular reference to the accompanying drawings.

PREFERRED EMBODIMENT OF THE INVENTION

Figure 1:
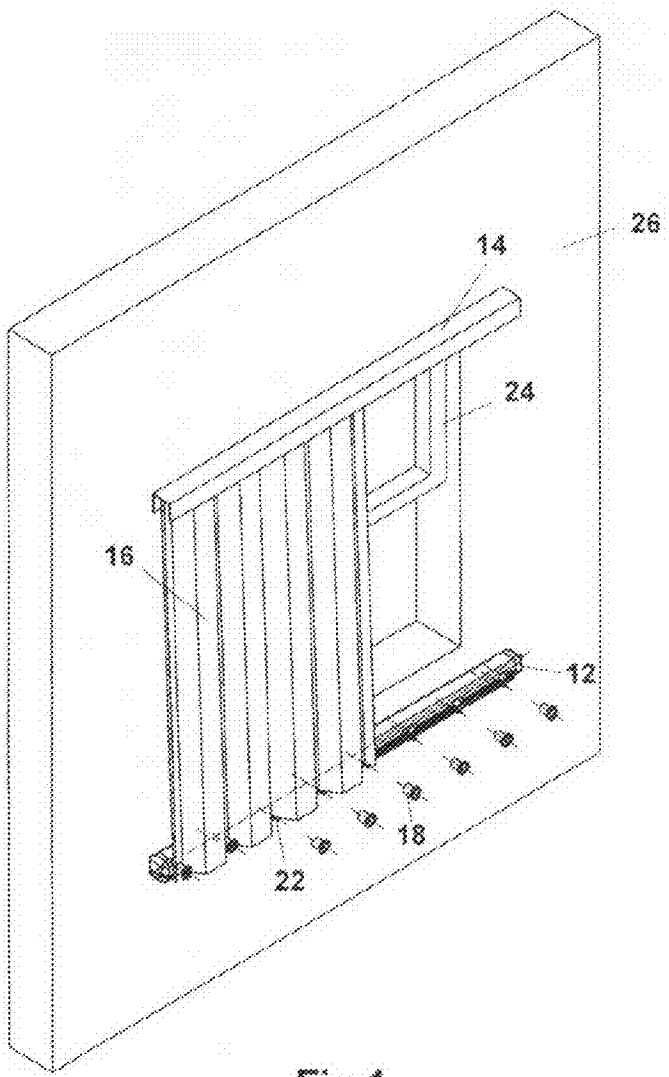
FIG. 1 shows a perspective view of a section of a building wall with a building window that is partially covered by storm shutters in accordance with the present invention.

Referring now to the drawings and, in particular, FIG. 1, a building wall 26 is shown having a window 24 that is partially covered by a hurricane shutter panel 16. The hurricane shutter panel 16 may be made of durable metal or aluminum and as shown is corrugated and sized to extend above and below the window when in place. The entire shutter 16 is not shown so that the window area and quick release housing 12 can be viewed. Shutter 16 is held in place by a U-shaped track 14 that is mounted to building wall 26 above the window 24 and a plurality of individually removable exterior fasteners 18 connected to a plurality of removable studs 22 that can be locked in place or released quickly from the quick release housing 12. Not shown in FIG. 1 is a release lever hidden behind shutter 16 that is attached to a cam mechanism in the quick release housing 12 that releases all of the studs 22 at once when manually activated from inside the building 26 through the window opening 24. Fastener 18 can be conventional threaded nuts or of a quick release type.

Figure 2:
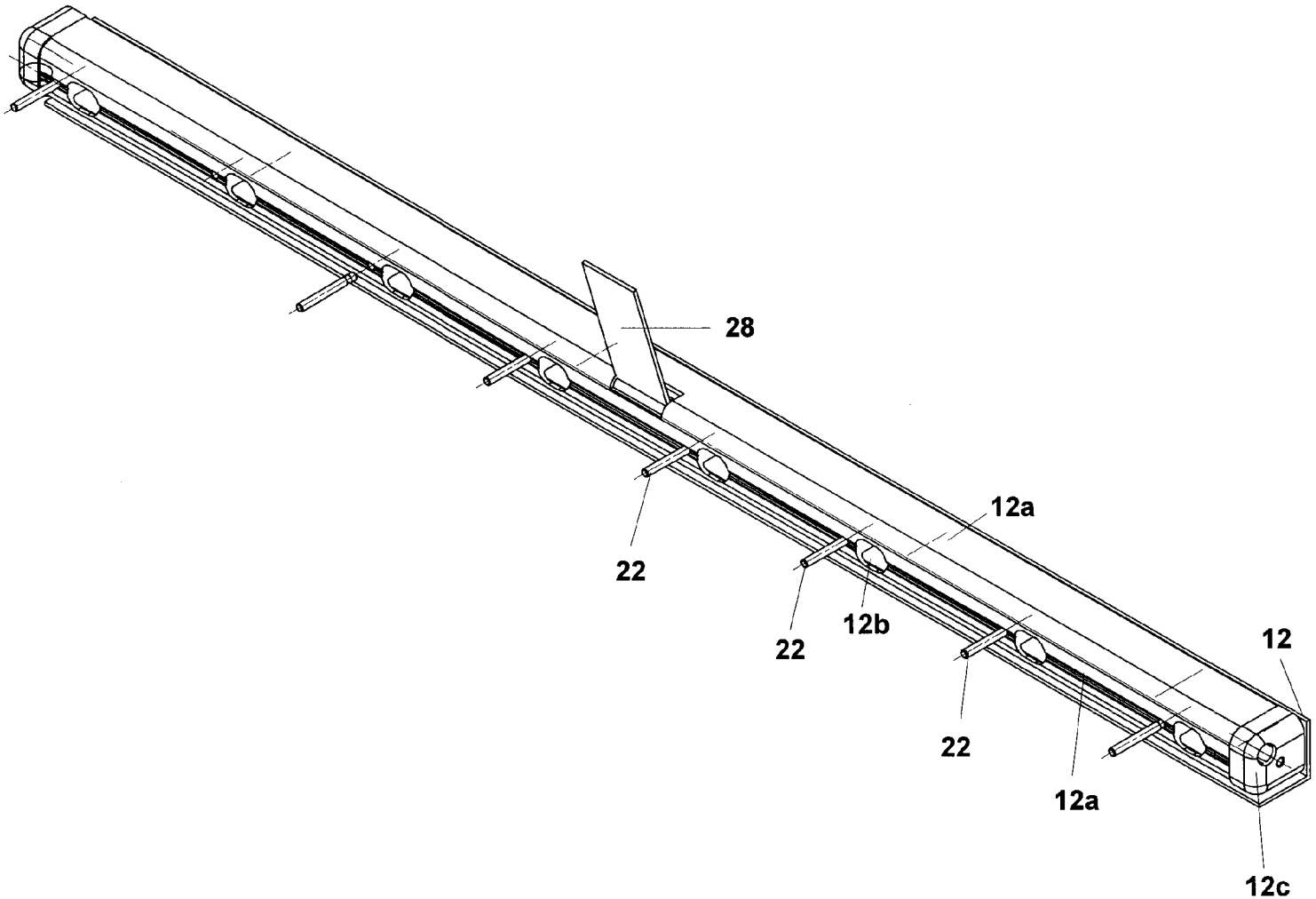
FIG. 2 shows a perspective view of a storm shutter fastener and quick release mechanism in accordance with the present invention.

Referring now to FIG. 2, the stud quick release housing 12 is shown that is used to both fasten and to quick release the storm shutter panels. The quick release housing 12 in the preferred embodiment is an extruded metal bar that can be of indeterminate length and cut for a specific window or door opening in length so that the housing 12 slightly exceeds the width of the door or window opening of the building to be protected. The quick release housing 12 includes an outer surface 12*a*, a plurality of apertures 12*b* along a front face that allow access through the housing 12 for anchoring the entire quick release housing 12 to a building wall, and end cover 12*c*. In the preferred embodiment, a plurality of wall anchors that would include a threaded bolt can be received through each aperture 12*b* and mounted and fastened within a female wall anchor that is threaded for firmly holding the quick release housing 12 to a building wall 26 as shown in FIG. 1.

Figure 3:
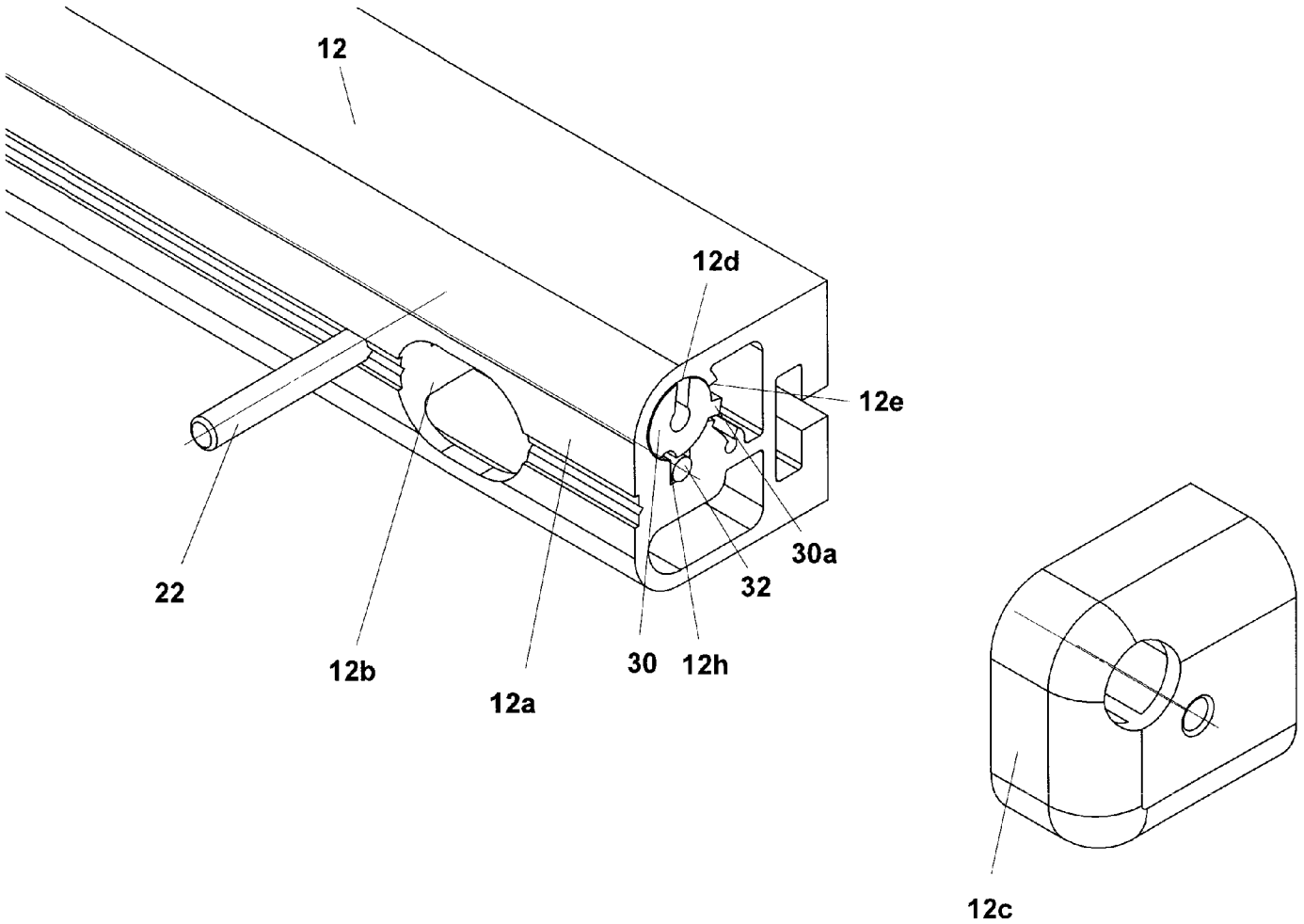
FIG. 3 shows a partial perspective view partially exploded of the quick release housing.

Referring now to FIG. 3, a plurality of shutter fastener studs 22 also project from the front face of quick release housing 12 perpendicularly. Each stud 22 may be threaded for receiving a quick release fastener that goes on the outside of each shutter panel that holds a shutter panel 16 (FIG. 1) to the quick release housing 12 when the shutters 16 are installed. Stud 22 would pass through holes that are present in the shutter panel 16 for attachment purposes. A release lever 28 (FIG. 2) actuates a cam mechanism disposed in the quick release housing 12 that acts to release and unfasten all of the studs 22 simultaneously from the quick release housing 12 if it is necessary to manually release the shutter panels 16 in an emergency from the inside of the dwelling. In an alternate embodiment, an additional release lever such as 28 (FIG. 2) could be disposed at one end of the quick release housing 12 for actuation from outside of the building which extends beyond the shutters attached thereto. Also a screw driver could be used from outside the building to rotate cam 30 in lieu of a release lever. The quick release housing 12 has a plurality of interior longitudinal channels 12*d* that includes an adjoining arc channel 12*e*. A cam 30 which is an elongated rod with a slot is placed in longitudinal channel 12*d*. The cam 30 includes a protrusion 30*a* that fits into the arc channel 12*e*. A cam protrusion 30*a* acts as a stop to the rotation of cam 30 by the release lever (not shown in FIG. 3) that allows a certain arc movement of cam 30 for locking and unlocking the studs 22.

Figure 4:
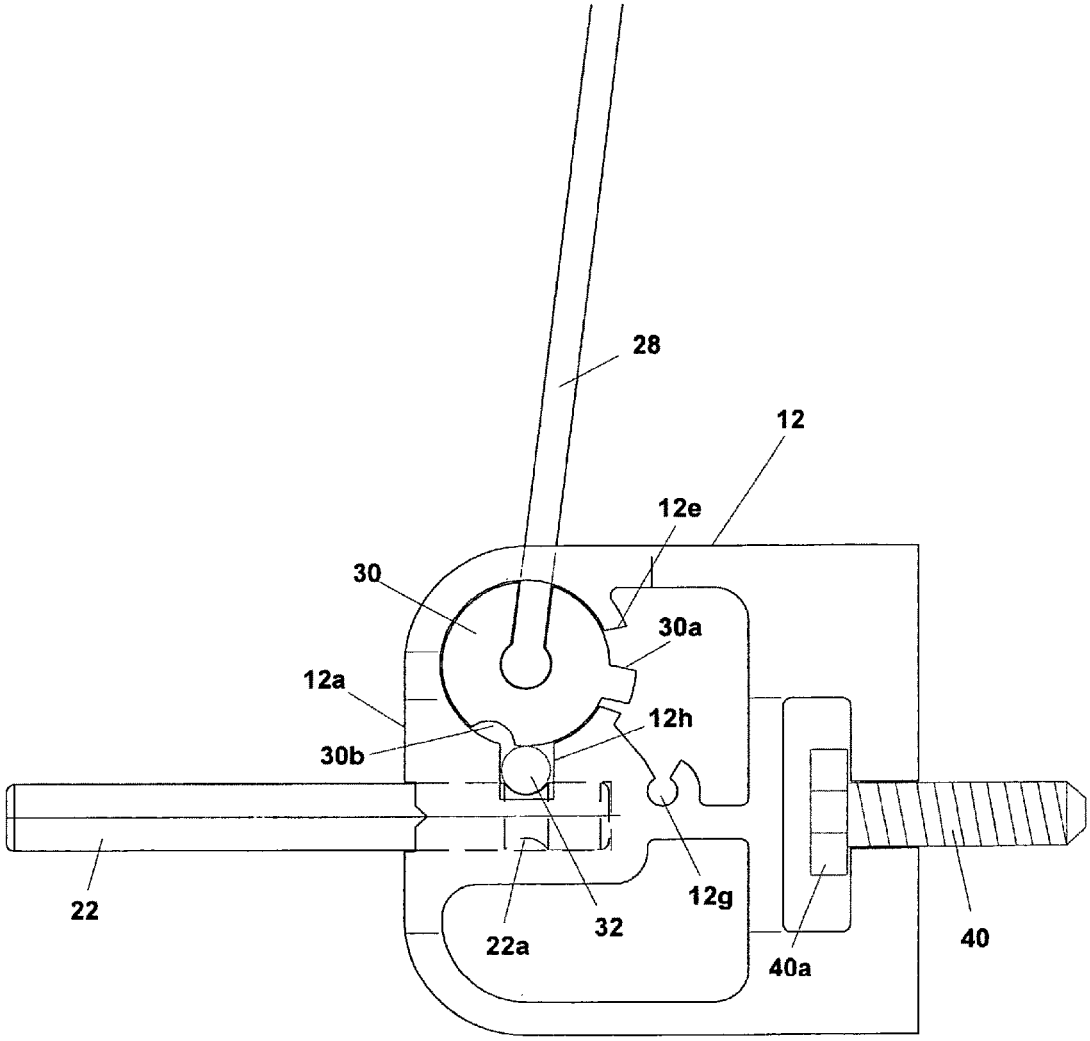
FIG. 4 shows a side elevational view of the fastener and quick release housing in accordance with the present invention wherein the shutter pin is locked in place by the cam mechanism.

Referring specifically to FIG. 4, an elongated rigid cylindrical metal rod 32 is vertically positionable in a quick release housing channel 12*h* which is substantially rectangular. The rod 32 is shown locking stud 22 to the quick release housing 12 by engaging stud 22 at an annular recessed portion 22*a* when the cam 30 is positioned such that the periphery of the cylindrical surface of cam 30 engages rod 32 directly, forcing rod 32 into recess 22*a* in stud 22. Note in FIG. 4 that the recess in cam 30 shown as 30*b* is positioned away from the rod 32. The cam 30 is locked in position and the cam protrusion 30*a* is stopped against arc channel 12*e* in housing 12. The release lever 28 is in the locked position.

Also shown in FIG. 4 is an anchor bolt 40 that is used to connect housing 12 to the wall of the building. A bolt head 40*a* secures bolt 40 which is threaded into a wall female anchor not shown in FIG. 4. By rotating and tightening bolt 40 with a socket wrench through the aperture 12*b* (shown in FIG. 3) in the housing 12, the entire quick release housing 12 can be fastened and firmly attached to a building wall to withstand hurricane force winds.

Figure 5:
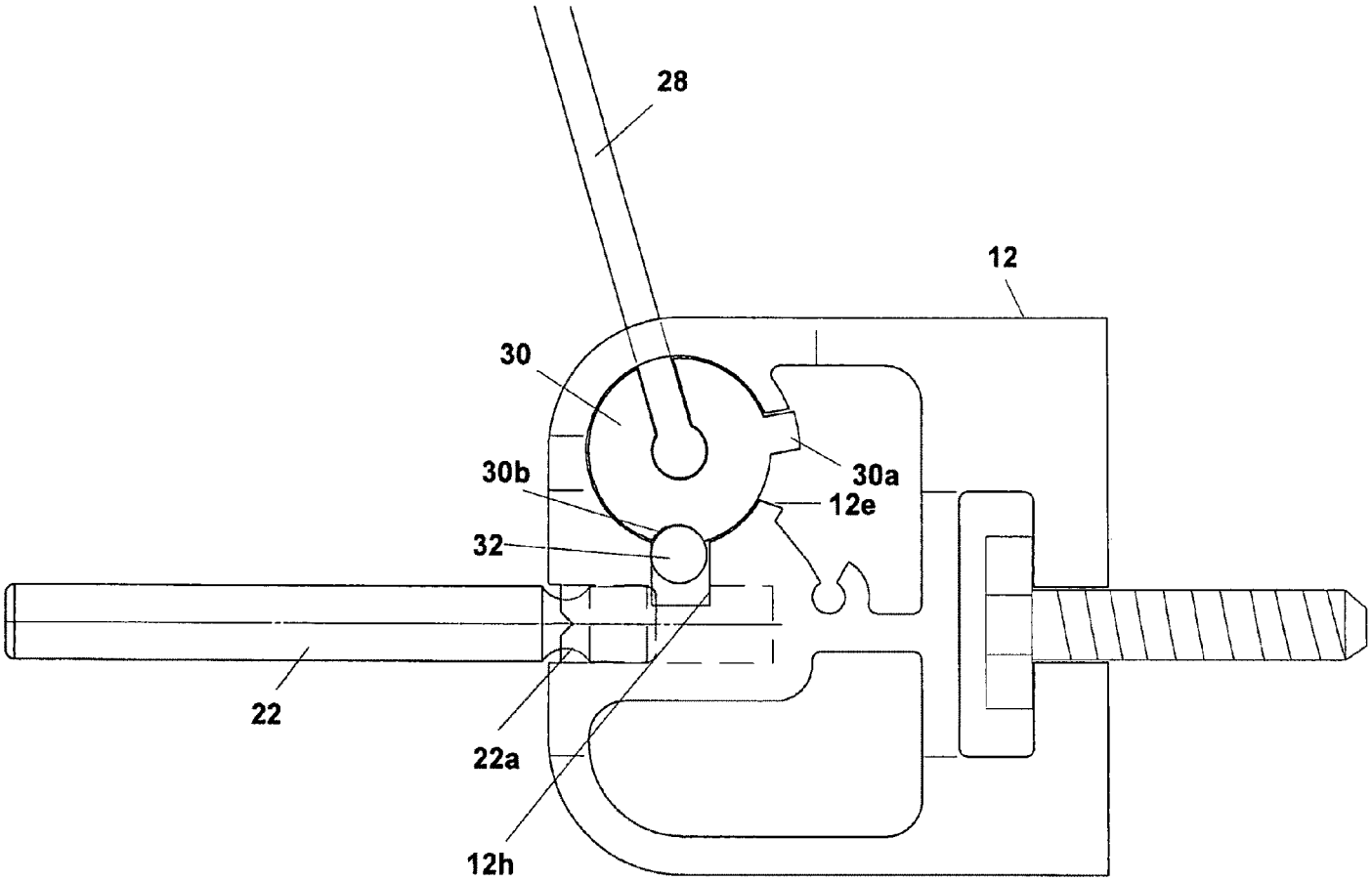
FIG. 5 shows a side elevational view of the fastener and quick release base wherein the stud fastener is unlocked with the cam mechanism.

Referring now to FIG. 5, the release lever 28 has been rotated so that cam protrusion 30*a* is touching and stops at the opposite end of the arc channel 12*e* wall. The recess 30*b* in cam 30 is now in direct contact with rod 32 so that the rod is now free to move up and down in channel 12*h*. As shown in FIG. 5, stud 22 is now disengaged from the quick release housing 12 allowing a shutter that is connected against quick release mechanism 12 to be released, allowing the shutter to be removed from covering the window or door from the inside of the building. Stated differently, when comparing FIGS. 4 and 5, a person trapped inside a building can rotate release lever 28 from the position shown in FIG. 4, which has the shutter locked in place, to a release position shown in FIG. 5 where the studs 22 are unlocked and released from quick release housing 12. Although the release lever 28 is shown positioned approximately in the center of the quick release housing 12, a second release lever can be placed at the very end of the quick release housing for outdoor exposure so that a person outside of the building could also rotate a release lever for a quick release of all of the studs that hold the shutter panel in place. Alternatively, a screw driver can be used at the end of the quick release housing to rotate cam 30 to release the studs 22.

Figure 6:
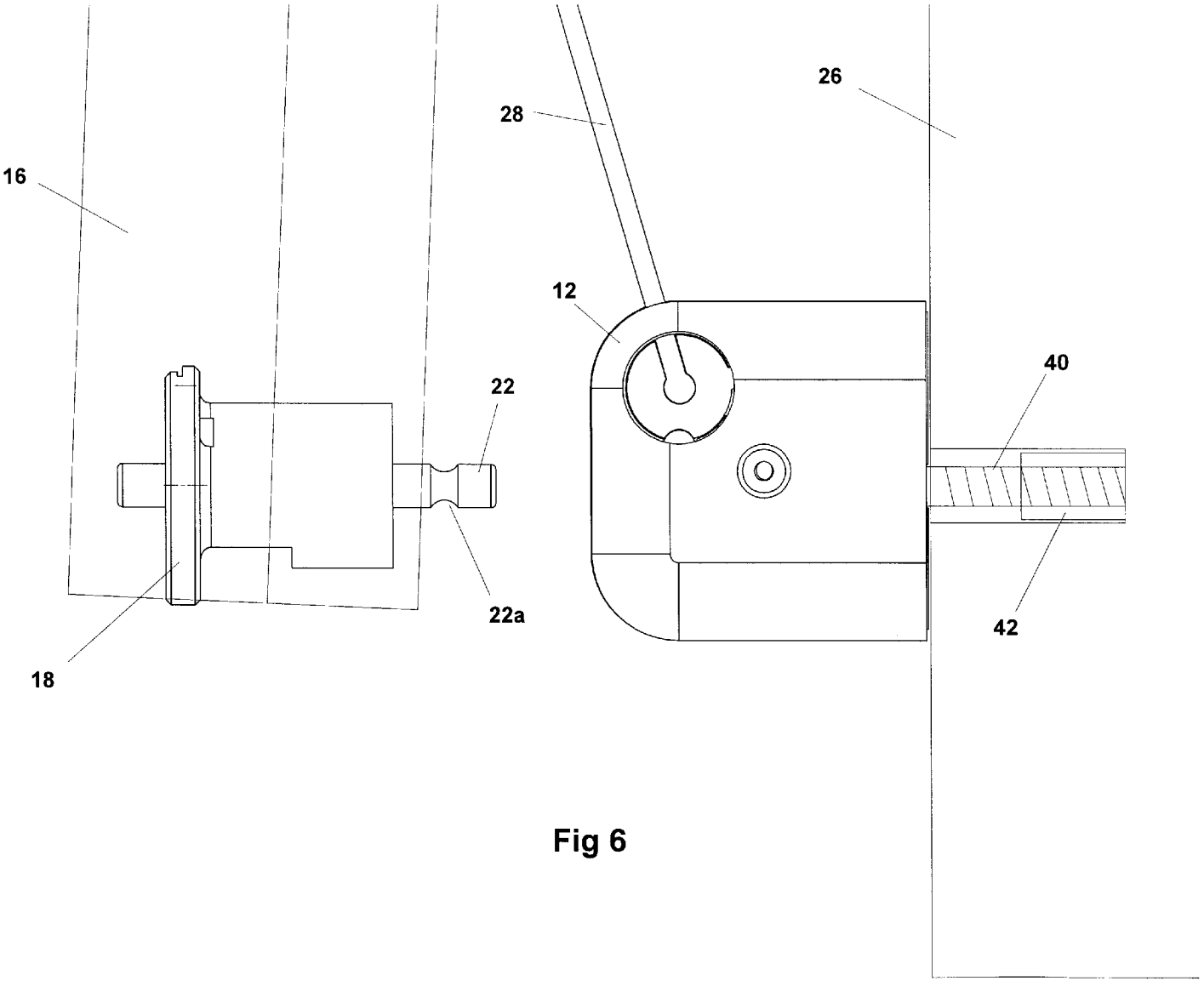
FIG. 6 shows a side elevational view of a shutter that is unfastened by its fastener stud from the fastener and quick release housing.

Referring now to FIG. 6, the entire system is shown. Shutter 16 is shown disengaged from quick release housing 12. However, stud 22 having a recess 22*a* is engaged through a hole in the shutter 16 and the quick release fastener 18 is mounted on the outside area of shutter 16. Quick release fastener 18 prevents the shutter 16 from moving to the left. Release lever 28 is shown emanating from the top of quick release housing 12 which is firmly attached to building wall 26 by a female anchor 42 mounted inside wall 26 and threaded fastener 40 which holds the quick release housing 12 to the wall 26.

Figure 7:
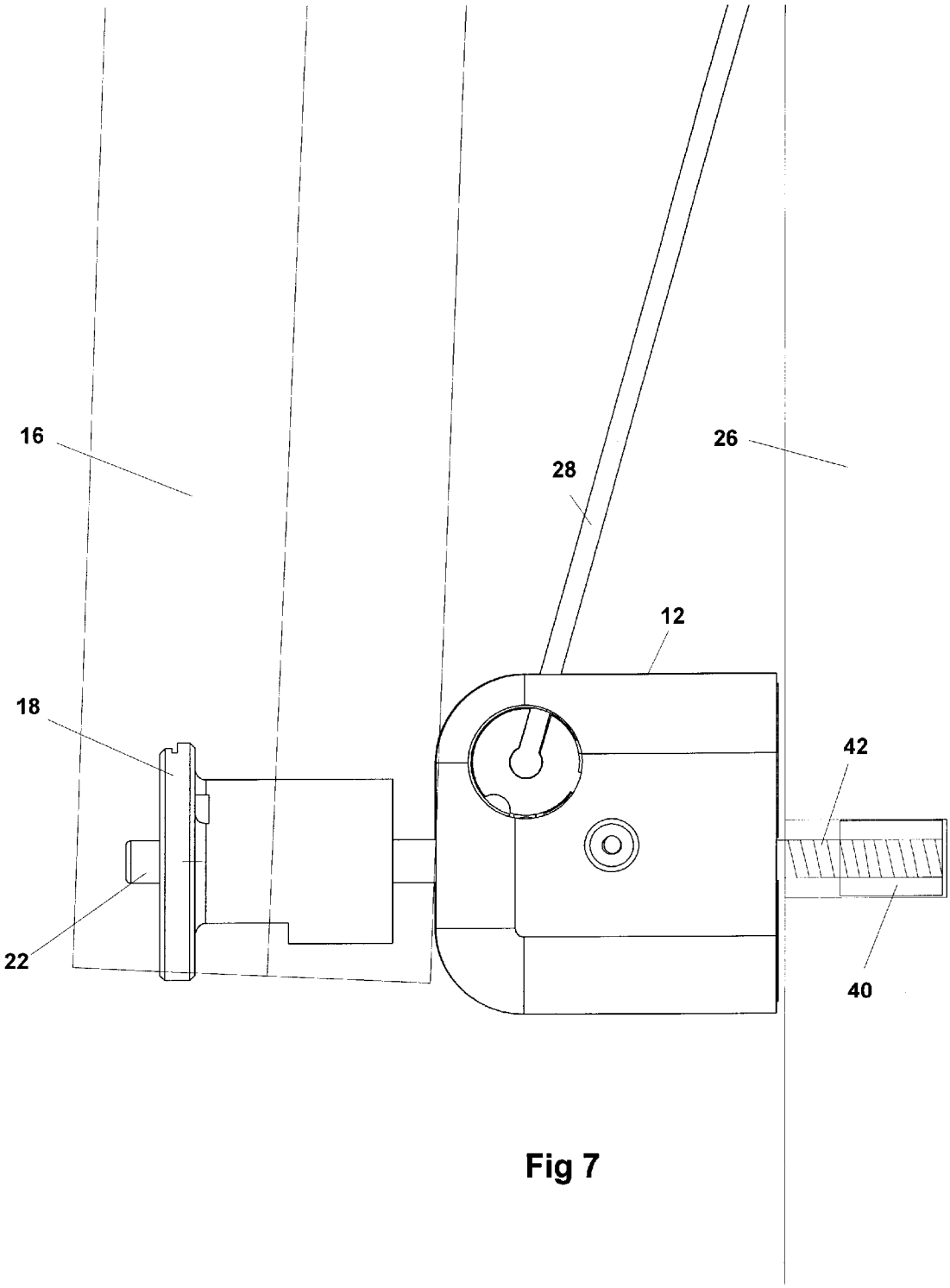
FIG. 7 shows a side elevational view of a fastener and quick release housing, a shutter and the shutter fasteners in the locked position for holding the storm shutters to a building.

Referring now to FIG. 7, the shutter 16 is firmly attached to wall 26 by being locked in place with stud 22 and all of the studs used to secure shutter 16 that are locked in accordance with the position shown in FIG. 4 by cam 30. As shown in FIG. 7, shutter 16 is locked in track 14 (FIG. 1) at the top and at the bottom by quick release housing 12 and stud 22 and quick release fasteners 18.

To operate the device for quick release and egress by someone inside the building, the person would reach through building window 24 as shown in FIG. 1, move lever arm 28 from the locked position shown in FIG. 7 and FIG. 4 to the unlocked position shown in FIG. 5, releasing all of the studs 22 that are engaged with quick release housing 12. Once all the studs have been released, the base of shutter 16 can be pushed away from quick release housing 12 quickly and easily allowing the shutter to fall away so that a person inside can readily get out through the window.

In relation to other considerations like the safety of firemen, each of the quick release fasteners 18 can be quickly removed from each stud individually 22 without having to thread, unthread or rotate the quick release fastener.

The present invention is shown as a safety device to allow a person trapped inside a building that is covered with hurricane or storm shutters over each door or window to quickly and easily exit the building through any opening by a simple maneuver of manually pushing a release lever that releases all of the studs holding a particular shutter panel in place instantly. In an alternate embodiment, the cam can be actuated from the outside of the building for ingress, if necessary, in an emergency for operation by someone manually.

Figure 8A:
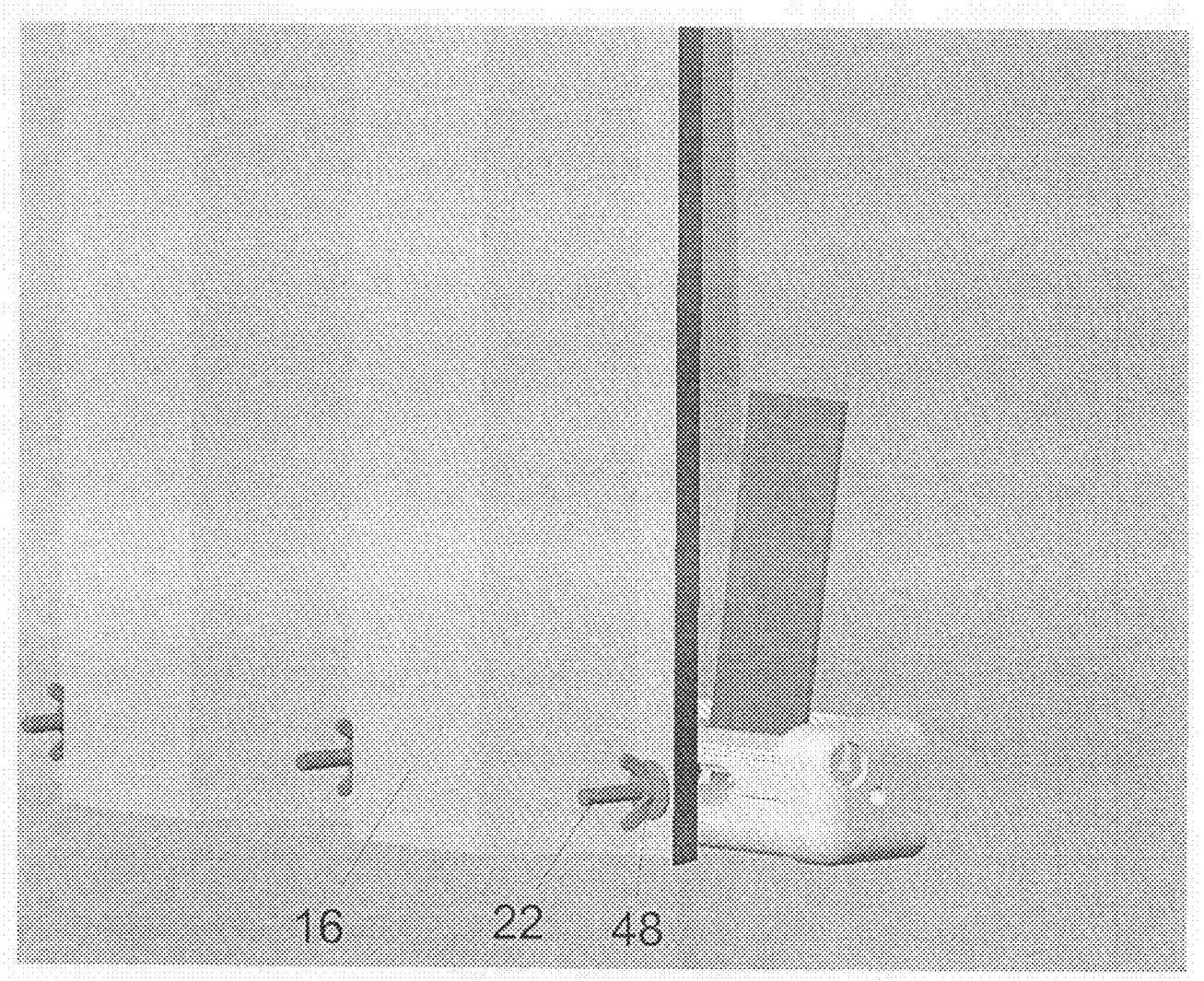
FIG. 8*a* shows a perspective view of the present invention in the secured mode of operation with the shutters tightly fixed to the quick release housing.

Referring now to FIG. 8*a*, a perspective view partially cut away of the present invention is shown that includes a partial view of the quick release housing 12 mounted against a wall with studs 22 firmly attached to the quick release housing 12. On the outside of shutters 16 are conventional wing nuts 48 each of which is threadably attached to each stud 22. One way to remove the shutter 16 from the building on the outside of the building as shown in FIG. 8*a* would be to manually rotate each wing nut 48 loosely from stud 22 until the wing nut is completely removed thus allowing the shutter 16 to be removed from the wing nut and stud 22. From the inside of the building (on the opposite side of shutter 16) the shutter is released by manually activating the release lever 28. All of the studs connected to the quick release housing 12 will simultaneously be released from the housing 12 freeing the shutter 16.

Figure 8B:
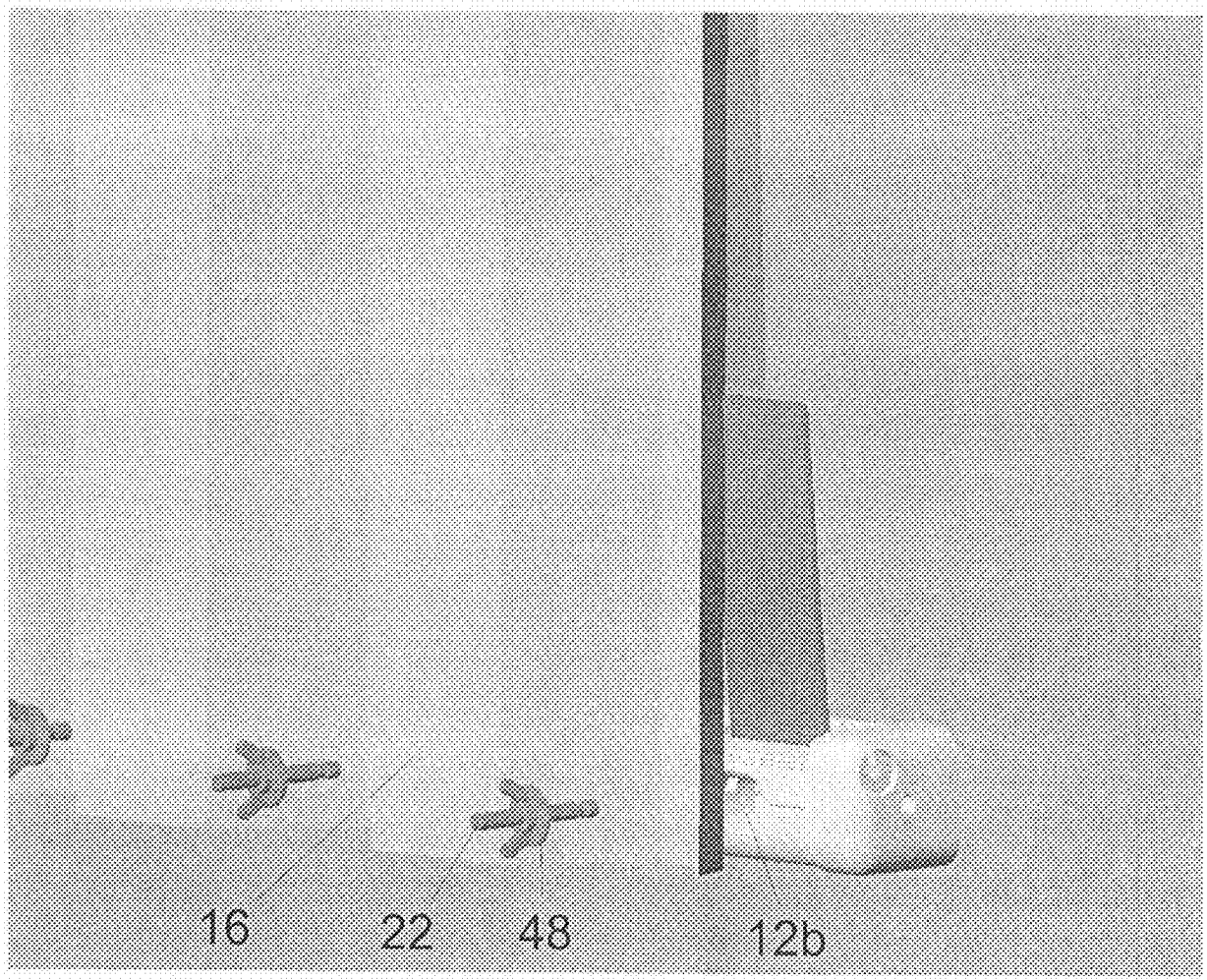
FIG. 8*b* shows the perspective view of FIG. 8*a* with the studs released from the quick release housing shown suspended in front of the shutters. Note that the outside fasteners are wing nuts.

Referring now to FIG. 8*b*, the studs 22 are shown in an exploded view away from the outside face of shutter 16 completely disengaged from the quick release housing 12. In this instance, after the release lever 28 has been activated manually and the studs are loosened from the release housing 12, the person inside the building would push on shutter 16 from the inside quickly releasing all the studs from the housing 12. In this particular case, the threaded wing nuts need not be removed since all of the studs are released from the quick release housing 12. However, with the embodiment shown in FIGS. 8*a* and 8*b*, there is no quick release mechanism from outside of the dwelling other than manually removing each of the wing nuts 48.

Figure 9:
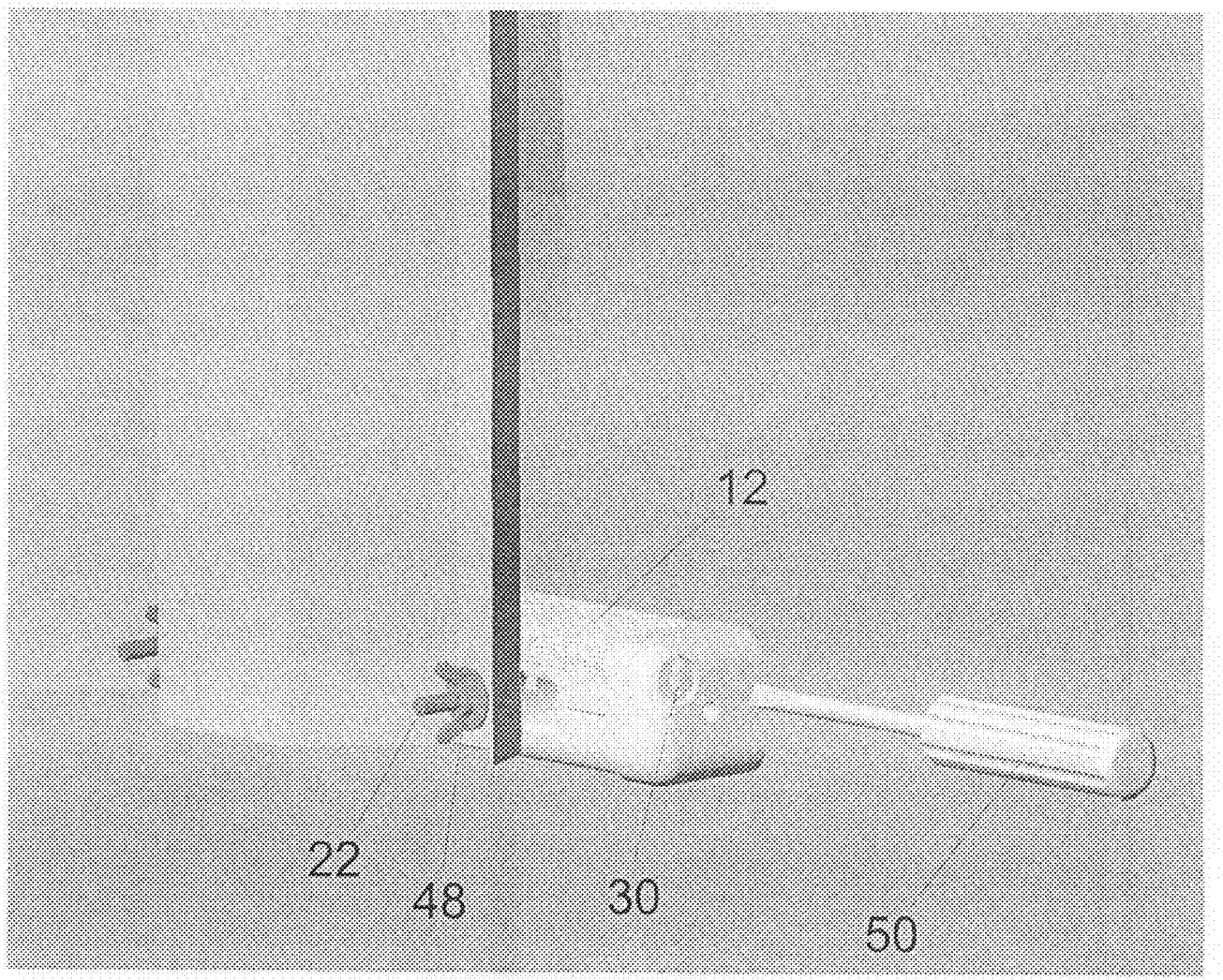
FIG. 9 shows an alternate embodiment of the invention in a perspective view partially cut away that shows a screw driver positioned near one end face of the quick release housing that can be used to release the studs from the quick release housing.

In order to alleviate the problem of having no outside access into the building as shown in FIG. 8*a* and FIG. 8*b*, an alternate embodiment is shown in FIG. 9. In this embodiment, the shutter 16 is firmly attached to the building and to the quick release housing 12 again by threaded wing nuts 48 connected to each stud. Again, in this particular view, the threaded wing nuts 48 would be necessarily removed by hand in order to remove shutter 16 unless the studs 22 can again be released from quick release housing 12. As shown in FIG. 9, a conventional screw driver 50 is shown at some distance from the cam 30 that includes a convenient slot at the end face 12*e* of the quick release housing 12. The screw driver end tip fits into the slot shown in cam 30 allowing manual rotation of cam 30 from the outside of the building which activates the stud 22 release as shown previously in this application for actuation. This arrangement shown in FIG. 9 of using a screw driver eliminates the problem of outside ingress into the building by allowing someone outside the building with a screw driver 50 to quickly release all studs 22 that are locked to the quick release housing 12 by rotation of cam 30. This also would alleviate the necessity of trying to manually remove each threaded wing nut 48 from each stud 22 which would be very time-consuming. Thus, the embodiment shown in FIG. 9 clearly allows quick removal and easy access from both inside the building and from outside the building using the screw driver 50 that would egress into the building and quick removal of the shutters 16.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A storm shutter quick release system for use with storm shutters that cover window and door openings of a building comprising:

an elongated stud quick release housing;

a plurality of studs attachable to a shutter for holding a shutter in position over a window or door opening for protection and releasably connectable to said quick release housing;

means for connecting said quick release housing to a building;

means for fastening a shutter to said studs attachable to said quick release housing;

means for attaching all of said studs to said quick release housing; and means for manually detaching all studs attached to said quick release housing thereby releasing said shutter from said quick release housing.

2. A storm shutter quick release system as in claim 1, wherein:

said means for releasably attaching said stud to said quick release housing includes an elongated rod with a slot sized to receive a stud having a first position locking said stud to said quick release housing and a second position for releasing said stud from said quick release housing.

3. A storm shutter quick release system as in claim 1, including:

said means for fastening said stud to a shutter including a quick release fastener.

4. A storm shutter quick release system as in claim 2, including:

a stud release lever attached to said elongated rod movable from a first position for locking said studs to said quick release housing to a second position releasing said studs from said quick release housing, said release lever positioned for activation by a person inside said building to release said shutter from said building from the inside.

5. A storm shutter quick release system for use with a storm shutter that is used to cover a building opening such as a window or a door, said storm shutter including at least one rigid panel comprising:

a quick release elongated housing including an elongated rigid bar having at least one internal longitudinal passage;

a plurality of studs each having an elongated body for attaching a shutter to said quick release housing, a segment of each of said stud bodies mountable inside of said quick release housing;

said quick release housing including a plurality of stud receiving channels along the front face of said quick release housing;

a wall anchor connected to said quick release housing for mounting said quick release housing to a building wall;

a locking member engagable with said stud bodies for locking said studs to said quick release housing in a first position, said locking member having a second position for disengaging said stud bodies within said quick release housing; and at least one exterior fastener removably attachable to said stud for holding a shutter panel and fastening the shutter panel to said quick release housing from the exterior of the shutter panel.

6. A storm shutter quick release system as in claim 5, including:

said locking member including an elongated rod having a slot sized to receive a stud mounted in said quick release housing longitudinal passage;

a rigid member disposed longitudinally in said quick release housing engagable with said elongated rod and with said studs in a first position of said elongated and disengageable with said studs in a second position of said elongated rod whereby the rod can lock the studs to the quick release housing or unlock the studs allowing the studs to be released from the quick release housing.

* * * * *